US009290292B2

(12) United States Patent
Sain

(10) Patent No.: US 9,290,292 B2
(45) Date of Patent: Mar. 22, 2016

(54) MACHINE FOR INSERTING HONEYCOMB SEPARATORS IN BOXES

(75) Inventor: Marino Sain, Roveredo in Piano (IT)

(73) Assignee: BORTOLIN KEMO S.P.A., Porcia (IT)

( * ) Notice: Subject to any disclaimer, the term of this patent is extended or adjusted under 35 U.S.C. 154(b) by 413 days.

(21) Appl. No.: 13/704,407

(22) PCT Filed: Mar. 30, 2012

(86) PCT No.: PCT/IB2012/051542
§ 371 (c)(1),
(2), (4) Date: Dec. 14, 2012

(87) PCT Pub. No.: WO2012/140533
PCT Pub. Date: Oct. 18, 2012

(65) Prior Publication Data

US 2013/0274081 A1 Oct. 17, 2013

(30) Foreign Application Priority Data

Apr. 12, 2011 (IT) ..... MO2011A0079

(51) Int. Cl.

| | |
|---|---|
| ***B65D 5/49*** | (2006.01) |
| ***B65B 43/30*** | (2006.01) |
| ***B31B 11/00*** | (2006.01) |
| ***B65B 61/20*** | (2006.01) |
| ***B31B 1/00*** | (2006.01) |

(52) U.S. Cl.
CPC ..... *B65D 5/48038* (2013.01); *B31B 1/00* (2013.01); *B65B 43/305* (2013.01); *B65B 61/207* (2013.01); *B31B 2217/105* (2013.01); *B65D 5/48026* (2013.01)

(58) Field of Classification Search
CPC .... B65B 61/207; B65B 61/202; B65B 61/24; B65B 61/20; B65B 43/30; B65B 43/32; B65B 43/305; B65B 43/325; B31B 11/00; B31B 2217/105; B65D 5/48026; B65D 5/48038
USPC ..... 493/374, 966, 91, 123; 53/445
See application file for complete search history.

(56) References Cited

U.S. PATENT DOCUMENTS

| | | | | |
|---|---|---|---|---|
| 3,952,633 | A * | 4/1976 | Nakai | 493/91 |
| 4,829,747 | A * | 5/1989 | Johnson et al. | 53/457 |
| 5,120,293 | A * | 6/1992 | Franklin | 493/125 |
| 5,597,113 | A * | 1/1997 | Bradford | B29C 65/02 229/120.07 |
| 6,128,886 | A * | 10/2000 | Johnson et al. | 53/445 |

(Continued)

FOREIGN PATENT DOCUMENTS

| | | | |
|---|---|---|---|
| DE | 23 56 319 | A1 | 5/1975 |
| EP | 1 529 728 | A1 | 5/2005 |
| FR | 2 654 071 | A1 | 5/1991 |

*Primary Examiner* — Andrew M Tecco
*Assistant Examiner* — Chelsea Stinson
(74) *Attorney, Agent, or Firm* — Pearne & Gordon LLP

(57) ABSTRACT

A machine for inserting honeycomb separators into boxes, comprising: at least two gripping elements (10, 20) predisposed for being associated to a first transversal wall (T1) and to a second transversal wall (T2) of a honeycomb and for rotating by a predetermined angle about a respective rotation axis (Z1, Z2); a first rotation mechanism, predisposed for rotating said gripping elements (10, 20) about the respective rotation axes (Z1, Z2); said first rotation mechanism comprises: a crossbar (2), which rotates parallel to itself on a horizontal plane, and a connecting mechanism which connects the crossbar (2) to the gripping elements (10, 20), said connecting mechanism being an articulated parallelogram.

13 Claims, 4 Drawing Sheets

(56) References Cited

U.S. PATENT DOCUMENTS 6,309,334 B1 * 10/2001 Planas Xapelli ... B65D 5/48026 493/150
2006/0073957 A1 * 4/2006 Martelli ..... B65B 43/305 493/71
2008/0300123 A1 * 12/2008 Bonnain ..... 493/310
2015/0031517 A1 * 1/2015 Cavazza ..... B31B 1/06 493/124
2015/0068163 A1 * 3/2015 Baltes ..... B31B 1/78 53/492

* cited by examiner

MACHINE FOR INSERTING HONEYCOMB SEPARATORS IN BOXES

TECHNICAL FIELD

The subject of the present invention is a machine for inserting honeycomb separators into boxes.

Honeycomb separators are typically structures made of cardboard or other material, which are inserted into a box to divide its internal space into a plurality of separate cells or compartments. The honeycombs to which the machine refers in particular comprise at least one longitudinal wall intersected with two or more transversal walls. FIG. 4 shows an example of a honeycomb separator formed of two longitudinal walls L1, L2 and three transversal walls T1, T2, T3. The various walls intersect with each other at notches. The various walls can rotate about each other at intersection notches to assume a flattened configuration, illustrated in FIG. 2, in which the various walls are arranged alongside each other in a pack, and an open configuration, in which the longitudinal walls L1, L2 are parallel to each other and are perpendicular to the transversal walls T1, T2, T3.

The machine which is the subject of the present invention is predisposed to pick up a honeycomb in flattened configuration, to rotate the various intersecting walls so as to bring the honeycomb to an open configuration. Subsequently the honeycomb can be inserted into a box.

Various types of machine are currently available for inserting honeycombs into boxes. Such machines comprise a first gripping element, predisposed for associating to a first longitudinal wall, and a plurality of further gripping elements predisposed for associating each one to a transversal wall. The first gripping element, with the exception of a horizontal translation movement to position itself in contact with the honeycomb to be picked up and a vertical movement to insert the honeycomb into a box, does not make any further movement with respect to the honeycomb itself. The gripping elements for the transversal walls, besides moving solidly with the first horizontal and vertical gripping element, also make a rotation movement of about 90° about a vertical axis which takes the transversal walls from an initial position in which they are arranged alongside the longitudinal walls in a pack and the honeycomb is in flattened configuration, to a final position in which the transversal walls are rotated by about 90° with respect to the initial position and the honeycomb assumes the open configuration.

In order to be able to perform the necessary rotation, the gripping elements for the transversal walls are each associated to a rotation arm which receives the rotary motion from a motor designated for the purpose.

The machines of known type are not capable of adapting effectively to honeycombs of different dimensions and number of walls. In order to be able to adapt a machine for a honeycomb of different dimensions, whether in relation to the length of the longitudinal walls, or to the length of the transversal walls, it is in fact necessary to vary the radius of rotation of each gripping element. Some minimal adjustments are possible by making each gripping element translate along its rotation arm, but these are extremely laborious and limited adjustments which make it possible to handle only a modest range of variation for the dimensions of the walls and for the relative position among the various walls.

The object of the present invention is to offer a machine for inserting honeycomb separators in boxes which makes it possible to exceed the limits of the currently available machines.

One advantage of the machine according to the present invention is to be extremely flexible and to be able to adapt simply and effectively to honeycomb separators of different dimensions and conformations.

Another advantage of the machine according to the present invention is that it reduces the overall moment of inertia of the parts which must make rotary movements, and makes it possible to limit the vibrations and overall expenditure of energy.

Further characteristics and advantages of the present invention will become clearer from the indicative, and therefore non-limiting, description of a preferred but not exclusive embodiment given below, with reference to the accompanying figures, in which.

Figure 1:
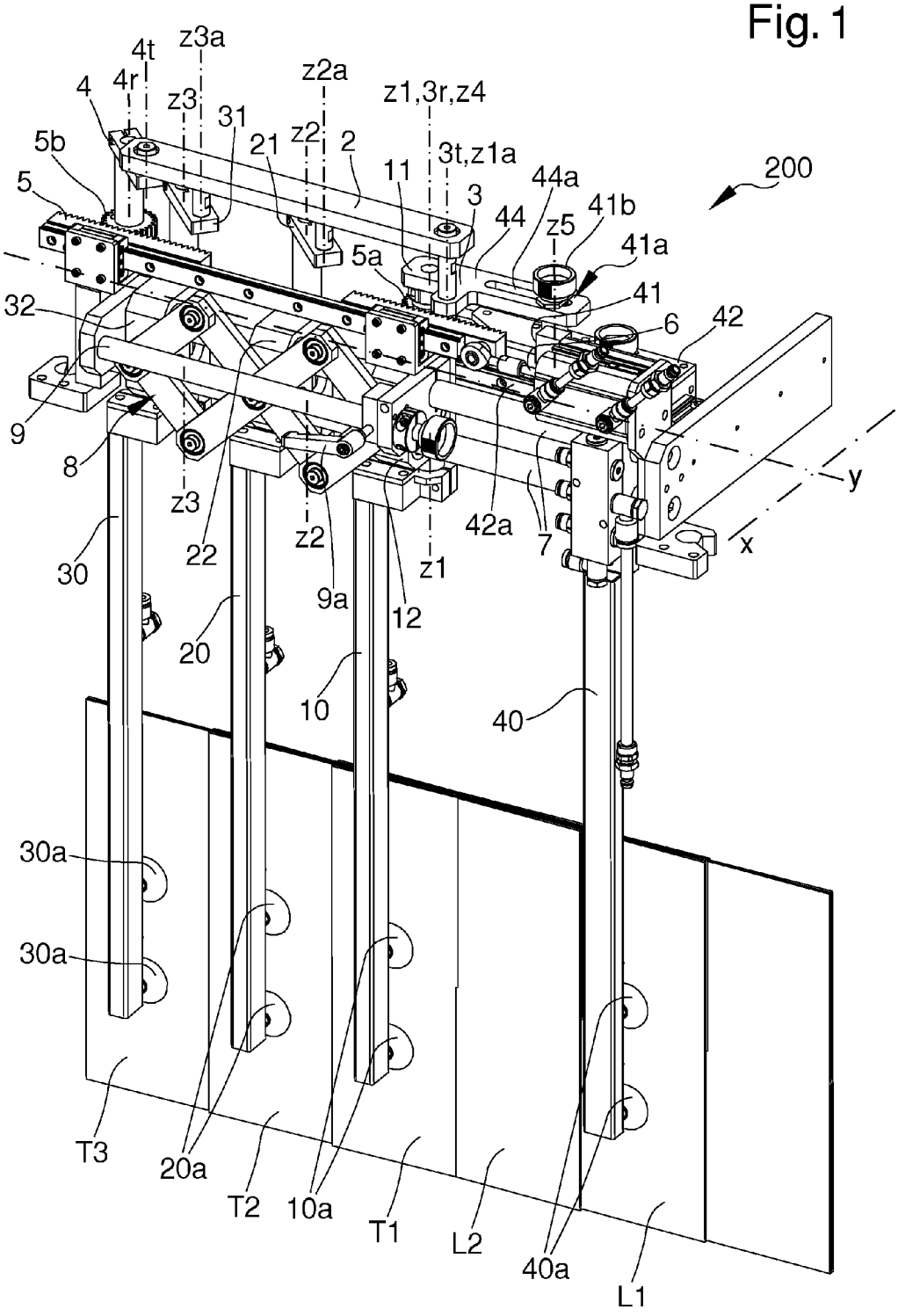
FIG. 1 shows an axonometric frontal view of the machine according to the present invention in a first position.

With reference to the aforesaid figures, the machine according to the present invention comprises a first gripping element 10, predisposed to associate to a first transversal wall T1 of a honeycomb and to rotate by a predetermined angle about a vertical rotation axis Z1. Preferably the first gripping element 10 is in the form of a bar equipped with one or more suckers 10*a* in proximity to a lower portion. The bar form allows the first gripping element, after being associated to a transversal wall T1 of a honeycomb, to be able easily to enter a box to insert the honeycomb itself.

A second gripping element 20 is predisposed to associate to a second transversal wall T2 of a honeycomb and to rotate by a predetermined angle about a vertical rotation axis Z2. The second gripping element too, for the same reasons as the first gripping element 10, is preferably in the form of a bar equipped with one or more suckers 20*a* in proximity to a lower portion. The presence of the first gripping element 10 and of the second and third gripping elements 20 make it possible to handle honeycombs equipped with two transversal walls T1, T2, and a longitudinal wall L1. The attached figures also show a third gripping element 30 similar to the first and second gripping elements 10, 20, predisposed to associate to a third transversal wall T3, if there is a third transversal wall T3, and to rotate by a predetermined angle about a vertical rotation axis Z3. The third rotation axis 30 too is provided with suckers 30*a*. Further gripping elements could be arranged consecutively to the first, second and third gripping elements described above for handling a larger number of transversal walls.

The gripping elements 10, 20, 30, together with the mechanisms and linkages which control their relative movements, are associated to a head 200 of the machine. The head 200 of the machine, by means of actuators not illustrated, moves between a feed position, in which it grips a honeycomb in flattened configuration, and an insertion position, in which the honeycomb is introduced into a box fed to the machine by a device predisposed for the purpose. The movement of the head 200 takes place substantially along a horizontal direction and a vertical direction. Starting from the feed position, the head 200 of the machine translates horizontally until it arrives above the position of a box below, and is subsequently lowered vertically to insert the honeycomb into the box. After releasing the honeycomb, the head 200 of the machine performs the movements in reverse and returns to the feed position of the honeycombs where a successive honeycomb is ready to be gripped.

The machine comprises a first rotation mechanism which is predisposed to rotate the gripping elements 10, 20, 30 by a predetermined angle about their rotation axes Z1, Z2, Z3. This first rotation mechanism comprises a crossbar 2 which rotates parallel to itself on a horizontal plane. In other words the first crossbar 2 is predisposed to perform a rotation on a horizontal plane without altering its inclination with respect to a longitudinal axis Y and a transversal axis X. In particular, the first crossbar 2 rotates on the horizontal plane, maintaining itself parallel to the longitudinal axis Y. The rotation movement of the first crossbar 2 is obtained by means of a first crank 3 and a second crank 4 which rotate about vertical axes 3*r*, 4*r* and are hinged on first crossbar 2 rotatably about axes 3*t*, 4*t* which are likewise vertical. The first and the second crank 3, 4 have the same length between their rotation axis 3*r*, 4*r* and the hinging axis 3*t*, 4*t* to the first crossbeam 2, so that an articulated parallelogram is formed between the first crossbar 2 and the two cranks 3, 4.

The first and the second crank 3,4 receive their rotary motion from an actuator which, in a preferred but not exclusive embodiment, comprises a rack 5 driven in alternating straight motion by means of a piston 6. The rack 5 meshes with two cogged wheels 5*a*, 5*b* solid and concentric with the first 3 and the second crank 4, so that the alternating motion of the rack 5 is transmitted to the cranks 3, 4 which perform their alternating rotary motion dragging in rotation the first crossbar 2 which, likewise, performs an alternating rotary movement.

The first 10, the second 20 and the third gripping element are connected to the first crossbar 2 by means of a connecting mechanism consisting of an articulated parallelogram. This connecting mechanism comprises a crank 11, 21, 31 for each gripping element 10, 20, 30. Each crank 11, 21, 31 rotates solidly with its own gripping element 20, 30, 40 about the respective rotation axis Z1, Z2, Z3. Each crank 11, 21, 31 is also pivoted to the first crossbar 2 about an auxiliary rotation axis Z1*a*, Z2*a*, Z3*a*. In each crank the rotation axis is parallel to the auxiliary rotation axis. Thanks to this type of connecting mechanism, the rotation of the crossbar 2 is transmitted to the cranks 11, 21, 31 of the gripping elements 10, 20, 30 which rotate about their own rotation axes Z1, Z2, Z3.

Figure 2:
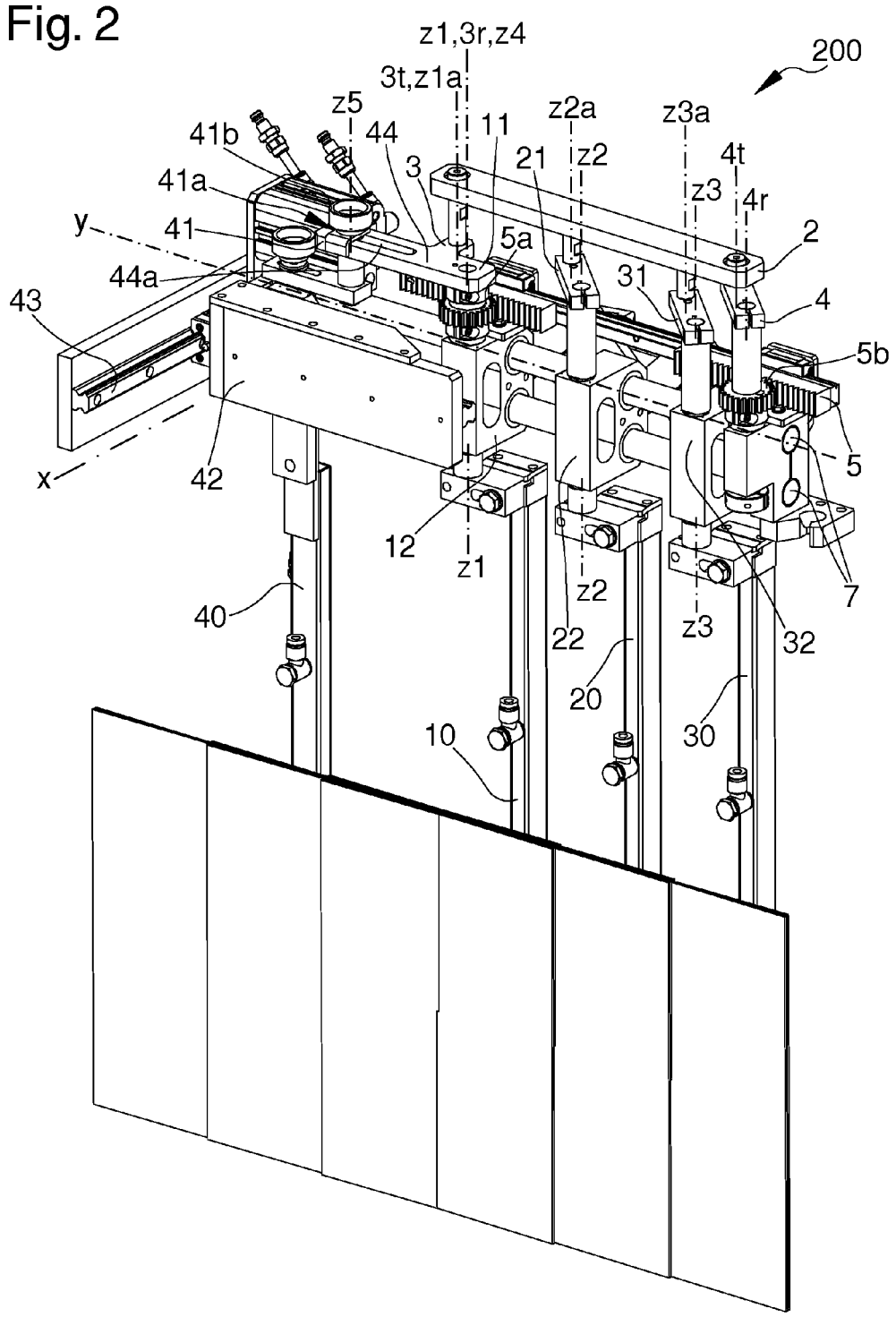
FIG. 2 shows the machine shown in FIG. 1 from a rear viewpoint.
Figure 3:
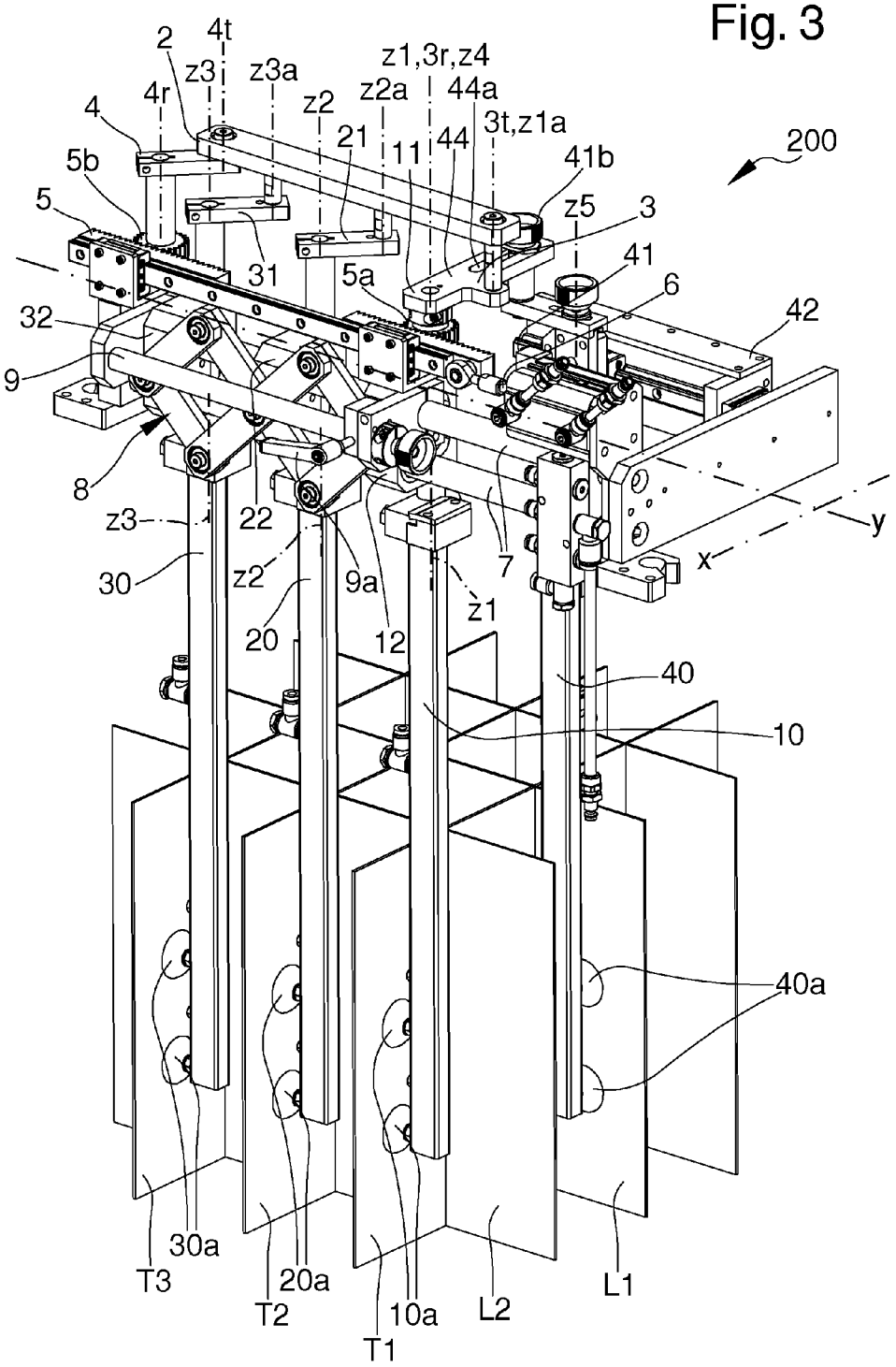
FIG. 3 shows the machine shown in FIG. 1 in a second position.
Figure 4:
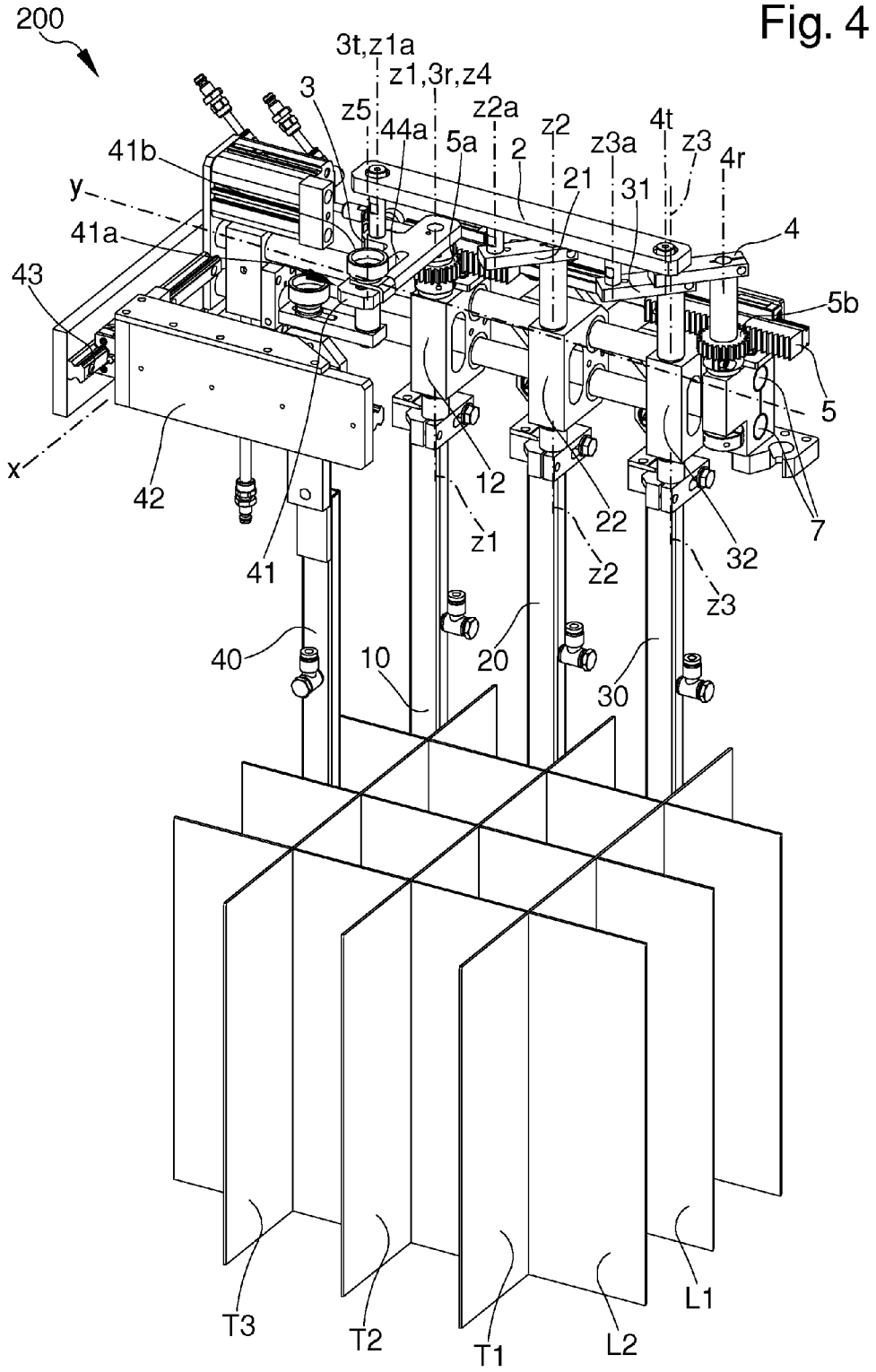
FIG. 4 shows the machine shown in FIG. 3 from a rear viewpoint.

The movement of the gripping elements 10, 20, 30 is therefore an alternating motion around the axes of rotation Z1, Z2, Z3. In particular each gripping element 10, 20, 30 rotates between a first position, in which it is aligned with the other gripping elements along the longitudinal direction Y and is able to be positioned in contact with a transversal wall T1, T2, T3 of a honeycomb in flattened configuration, as shown in FIGS. 1 and 2, and a second position, in which, following a rotation of about 90°, it is positioned perpendicularly with respect to the first position. In the second position of the gripping elements 10, 20, 30 the transversal walls T1, T2, T3 of the honeycomb are rotated by about 90° with respect to the initial position and the honeycomb assumes its open configuration (FIGS. 3 and 4).

The transmission connecting mechanism described above, comprising the first crossbar 2, offers a most important advantage. It allows the position of the gripping elements 10, 20, 30 to be varied along the longitudinal direction Y without this entailing any variation in the transmission of motion between the first crossbar 2 and the gripping elements themselves. In substance, the connecting mechanism allows the position of the auxiliary rotation axes Z1*a*, Z2*a*, Z3*a* of the cranks 11, 21, 31 of the gripping elements 10, 20, 30 to be varied at will.

To this end, each gripping element 10, 20, 30 is associated to a respective support 12, 22, 32 which is slidable parallel to the longitudinal direction Y. The supports 12, 22, 32 are mobile along a pair of guides 7 parallel to the longitudinal direction Y. Each crank 11, 21, 31 is also pivoted to the first crossbar 2 by means of a pin 11*a*, 21*a*, 31*a*, concentric with the auxiliary rotation axis Z1*a*, Z2*a*, Z3*a* of the crank, the head of which can slide along a slot, parallel to the longitudinal direction Y, formed on the lower face of the crossbar 2 (not visible in the attached figures).

A first adjustment device is predisposed to adjust the distance between the gripping elements 10, 20, 30. As is visible in FIGS. 1 and 2, this first adjustment device comprises a pantograph mechanism 8 associated to the supports 12, 22, 32 of the gripping elements 10, 20, 30. An endless screw 9, or other similar device, can be predisposed on the pantograph mechanism 8 to allow fine adjustment of the distance between the gripping elements 10, 20, 30. A locking device, activatable by means of a lever 9*a*, can be predisposed to lock the gripping elements 10, 20, 30 in the adjusted position.

The transmission connecting mechanism described above makes it possible furthermore to add other gripping elements or remove those present quickly and simply. It is in fact sufficient to remove the supports 12, 22, 32 for the gripping elements, fit the supports themselves to the guides 7 and connect the cranks 11, 21, 31 to the crossbar 2 by inserting the pins 11*a*, 21*a*, 31*a* of each crank into the slot formed in the lower face of the crossbar 2.

In the event that the honeycombs to be managed have two longitudinal walls L1, L2, the machine according to the present invention can be equipped with a fourth longitudinal gripping element 40 predisposed to be associated to a first longitudinal wall L1 of a honeycomb. The longitudinal gripping element 40, together with all the mechanisms which control its movement, has been represented in all the figures. The embodiment of the machine without the longitudinal gripping element 40 has not been represented as it is easily deducible by a person skilled in the art by removing from the attached figures the longitudinal gripping element 40 itself and all the mechanisms which control its movement.

The longitudinal gripping element 40 is preferably in the form of a bar equipped with one or more suckers 40*a* in proximity to a lower portion. The bar form allows the longitudinal gripping element 40, after being associated to a longitudinal wall L1 of a honeycomb, to be able easily to enter a box to insert the honeycomb itself, similarly to what happens with the other gripping elements 10, 20, 30.

The longitudinal gripping element 40 is movable in rotation around a first rotation axis Z4 and a second rotation axis Z5, parallel to each other, in such a way as to keep their own orientation constant.

In particular the longitudinal gripping element 40 is associated to a support mobile along a longitudinal direction Y and a transversal direction X perpendicular to each other. The support 41 for the longitudinal gripping element 40 is slidable along a guide 42*a* parallel to the longitudinal direction Y. The guide 42*a* is solid with a slide 42 which is slidable along a guide 43 parallel to the transversal direction X. This guide 43 is solid with the head of the machine.

The support 41 for the longitudinal gripping element 40 is rotatably constrained to a connecting rod 44 around the second rotation axis Z5 which is parallel to the first rotation axis Z4. This connecting rod 44 in its turn rotates around the first rotation axis Z4. The connecting rod 44 operates as a driver in relation to the longitudinal gripping element 40. It in fact receives the rotation movement about the first rotation axis Z4. The rotation of the connecting rod 44 is transmitted to the support 41 resolved into the direct movement components directed along the longitudinal direction Y and along the transversal direction X thanks to the coupling rotatable about the second axis of rotation Z5 between the connecting rod 44 and the support 41. Consequently, the gripping element 40 moves on a horizontal plane along the longitudinal direction Y and along the transversal direction X without altering its own orientation on this horizontal plane.

Advantageously the support 41 for the longitudinal gripping element 40 is fixable to the connecting rod 44 in an adjustable position with respect to the first rotation axis Z4 of the connecting rod 44 itself. In other words, the distance between the first rotation axis Z4 of the connecting rod 44 and the rotation axis Z5 of the connecting rod 44 with respect to the support 41 is adjustable. Consequently it is possible to vary the extension of the movements of the support 41, and therefore of the longitudinal gripping element 40, both along the longitudinal direction Y, and along the transversal direction X. This allows the machine to be able to adapt to honeycombs of different dimensions with a very simple adjustment of the position of the support 41 along the connecting rod 44. To this end the support 41 is connected to the connecting rod 44 by means of an idler pin 41*a* equipped with a locking screw 41*b*. This idler pin 41*a* is inserted into a slot 44*a* formed in the connecting rod 44. With the locking screw 41*b* slackened off it is possible to move the idler pin 41*a*, and therefore also the support, along the slot 44*a* to a desirable position in which, by tightening the locking screw 41*b*, it is possible to lock the idler pin 41*a*.

The longitudinal gripping element 40 is mobile between a first position and a second position. In the first position, shown in FIGS. 1 and 2, the longitudinal gripping element 40 is substantially aligned along the longitudinal direction Y with the other gripping elements 10, 20, 30 when they are in their first position. In the first position the longitudinal gripping element 40 is able to be positioned in contact with a first longitudinal wall L1 of a honeycomb in flattened configuration. With reference to the viewpoint of FIGS. 1 and 3, this first longitudinal wall L1 is destined, in the open configuration of the honeycomb, to assume a background or rearward position with respect to a second longitudinal wall L2. In the second position, shown in FIGS. 3 and 4, the longitudinal gripping element 40 is positioned at a determinate distance with respect to the first position after executing a travel of a pre-established size along the longitudinal direction Y and along the transversal direction X. In particular, in moving from the first to the second position, the longitudinal gripping element 40 moves away from the other gripping elements 10, 20, 30 and distances the first longitudinal wall L1 from the second longitudinal wall L2.

In a preferred embodiment of the machine, the connecting rod 44 is solid with the crank 11 of the first gripping element 10 and the first crank 3 of the crossbar 2. In substance, the connecting rod 44, the crank 11 of the first gripping element 10 and the first crank 3 of the crossbar 2 form a single body which rotates about the rotation axis 3*r* of the first crank 3 which, in this preferred embodiment of the machine, coincides with the rotation axis Z1 of the first gripping element 10 and with the first rotation axis Z4 of the connecting rod 44. This single body 3, 11, 44 is furthermore rotatably constrained to the crossbar 2 around the rotation axis 3*t* of the first crank 3 which coincides with the auxiliary rotation axis Z1*a* of the crank 11 of the first gripping element 10. In this way the single body 3, 11, 44 reassumes the functions of the first crank 3 of the crossbar 2, of the crank 11 of the first gripping element 10 and of the connecting rod 44. This does not prevent the first crank 3 of the crossbar 2, the crank 11 of the first gripping element 10 and the connecting rod 44 being made as distinct components with their respective rotation axes.

The single body 3, 11, 44 is also solid with a first cogged wheel 5*a* with respect to the rotation axis 3*r* of the first crank 3. As already mentioned previously, this cogged wheel 5*a* together with the second cogged wheel 5*b*, meshes with the rack 5 driven in alternating straight motion by means of the piston 6. The alternating motion of the rack 5 is transmitted to the single body 3, 11, 44 and to the second crank 4 of the crossbar 2 which perform their own alternating rotating motion, dragging in alternating motion the first crossbar 2 itself.

Therefore, when the machine is in operation, the alternating motion of the rack 5 is transmitted to the single body 3, 11, 44 and to the second crank 4 of the crossbar 2 which perform their own alternating rotating motion, dragging in alternating motion the first crossbar 2 itself. This entails that, in simultaneous and synchronised fashion, the longitudinal gripping element 40 moves from its first position towards its second position and the first 10, the second 20 and the third gripping element move from their first positions towards their second positions. In virtue of the synchronism between the movements of the gripping elements 10, 20, 30, 40, it is possible to globally identify a first position of the gripping elements themselves, shown in FIGS. 1 and 2, in which each gripping element is in its first position and, globally, the gripping elements are aligned along the longitudinal direction Y. With the gripping elements in this first position, the head of the machine can approach and associate to a honeycomb kept in its flattened configuration in a determinate position for feeding the machine. After having gripped the honeycomb by means of the gripping elements 10, 20, 30, 40, the head of the machine is driven in translation through a travel which can be resolved into a horizontal component and a downwards vertical component which brings the honeycomb into an insertion position in which, substantially, the honeycomb itself is introduced into a box fed to the machine by means of a feed device predisposed for the purpose. During the movement of the head of the machine from the described feed position towards the described insertion position, the gripping elements 10, 20, 30, 40 are activated simultaneously, moving them from the first position towards the second position, shown in FIGS. 3 and 4. The movement of the gripping elements 10, 20, 30, 40 entails a rotation of the transversal walls T1, T2, T3 from a position in which they are substantially parallel to the longitudinal direction Y in the flattened configuration of the honeycomb, to a position in which the transversal walls T1, T2, T3 are parallel to the transversal direction X in the open configuration of the honeycomb. The movement of the gripping elements 10, 20, 30, 40 entails simultaneously the movement of the first longitudinal wall L1 from a position in which it is alongside the second longitudinal wall L2 in the flattened configuration of the honeycomb (FIGS. 1 and 2), to a position in which it is remote from the second longitudinal wall L2 in the open configuration of the honeycomb (FIGS. 3 and 4). With the honeycomb open the head 200 of the machine descends towards the insertion position and introduces the honeycomb into a box located underneath. After releasing the honeycomb, the head 200 and the gripping elements 10, 20, 30, 40 perform the movements in reverse and return to the initial position.

The machine according to the present invention offers important advantages. It makes it possible quickly and simply to adjust the distance between the gripping elements 10, 20, 30 to adapt to honeycombs of different format and dimensions. It also makes it possible to add or remove gripping elements quickly and simply. Further possibility of adjustment offered by the machine relates to the quick and simple adjustment made to movement of the longitudinal gripping element 40: this adjustment enables the machine to be adapted to honeycombs with longitudinal walls separated by different distances.

The invention claimed is:

1. A machine for inserting honeycomb separators in boxes, comprising:

at least two gripping elements (10, 20) predisposed such as to associate to a first transversal wall (T1) and to a second transversal wall (T2) of a honeycomb and to rotate by a predetermined angle about a respective rotation axis (Z1, Z2); a first rotation mechanism, predisposed to rotate said gripping elements (10, 20) about the respective rotation axes (Z1, Z2); said first rotation mechanism comprising: a crossbar (2), which rotates on a horizontal plane without modifying its inclination with respect to a longitudinal axis (Y) and to a transversal axis (X), and a connecting mechanism which connects the crossbar (2) to the gripping elements (10, 20), said connecting mechanism being an articulated parallelogram;

said connecting mechanism that connects the crossbar (2) to the gripping elements (10, 20) comprising: a crank (11, 21), associated to each gripping element (10, 20), which rotates about a rotation axis (Z1, Z2) solidly with the gripping element (10, 20) and is pivoted to the crossbar (2) about an auxiliary rotation axis (Z1*a*, Z2*a*) by means of a pin (11*a*, 21*a*);

characterised in that the position of the auxiliary rotation axes (Z1*a*, Z2*a*) of the cranks (11, 21) of the gripping elements (10, 20) can be varied along the longitudinal direction (Y) by means of said pins (11*a*, 21*a*).

2. The machine according to claim 1, wherein the crossbar (2) is activated to rotate by means of a first crank (3) and a second crank (4) which rotate about vertical axes (3*r*, 4*r*) and are pivoted to the crossbar (2) rotatably about vertical axes (3*t*, 4*t*) such that an articulated parallelogram is defined between the crossbar (2) and the two cranks (3, 4).

3. The machine according to claim 2, wherein the first crank (3) and the second crank (4) are solid in rotation about the axes thereof (3*r*, 4*r*) with a respective cogged wheel (5*a*, 5*b*), said cogged wheels (5*a*, 5*b*) meshing with a rack (5) activated in alternating straight motion.

4. The machine according to claim 1, wherein the auxiliary rotation axes (Z1*a*, Z2*a*) are slidable along the crossbar (2).

5. The machine according to claim 1, wherein the gripping elements (10, 20) are each associated to a support (12, 22) that is slidable along a longitudinal direction (Y).

6. The machine according to claim 1, comprising a first regulating device predisposed for adjusting the distance between the gripping elements (10, 20).

7. The machine according to claim 6, wherein said first regulating device comprises a pantograph mechanism (8).

8. The machine according to claim 1, comprising a longitudinal gripping element (40), predisposed to associate to a first longitudinal wall (L1), which is mobile in rotation on a horizontal plane about a first rotation axis (Z4) in such a way as to maintain the orientation thereof constant.

9. The machine according to claim 8, wherein the longitudinal gripping element (40) is associated to a support (41) that is mobile along a longitudinal direction (Y) and a transversal direction (X) that are perpendicular to one another.

10. The machine according to claim 9, wherein the support (41) of the longitudinal gripping element (40) is pivoted, about a second rotation axis (Z5), to a connecting rod (44) which rotates about the first rotation axis (Z4).

11. The machine according to claim 10, wherein the support (41) of the longitudinal gripping element (40) is fixable to the connecting rod (44) in an adjustable position with respect to the first rotation axis (Z4) of the connecting rod (44).

12. The machine according to claim 11, wherein the connecting rod (44) is solidly constrained to the crank (11) of the first gripping element (10) and to a first crank (3) of the crossbar (2) such that a single body (3,11, 44) is defined, which rotates about the rotation axis (3*r*) of the first crank (3), said rotation axis (3*r*) of the first crank (3) being coincident with the rotation axis (Z1) of the first gripping element (10) and with the first rotation axis (Z4) of the connecting rod (44).

13. The machine according to claim 12, wherein said single body (3, 11, 44) is further constrained rotatably to the crossbar (2) about a hinge axis (3*t*) of the first crank (3), said hinge axis (3*t*) being coincident with the auxiliary rotating axis (Z1*a*) of the crank (11) of the first gripping element (10).

* * * * *